US006637818B2

(12) United States Patent
Williams

(10) Patent No.: US 6,637,818 B2
(45) Date of Patent: Oct. 28, 2003

(54) PORTABLE LIFT SEAT APPARATUS

(76) Inventor: Jerry Wayne Williams, 5300 Valhalla Dr., Carmichael, CA (US) 95608

( * ) Notice: Subject to any disclaimer, the term of this patent is extended or adjusted under 35 U.S.C. 154(b) by 0 days.

(21) Appl. No.: 10/219,022

(22) Filed: Aug. 13, 2002

(65) Prior Publication Data

US 2003/0038518 A1 Feb. 27, 2003

Related U.S. Application Data

(60) Provisional application No. 60/314,955, filed on Aug. 24, 2001.

(51) Int. Cl.[7] ..... A47C 1/02

(52) U.S. Cl. ..... 297/330; 297/DIG. 10; 297/337; 297/339; 297/344.17

(58) Field of Search ..... 297/DIG. 10, 337, 297/339, 344.17, 330; 248/419, 421, 395

(56) References Cited

U.S. PATENT DOCUMENTS 3,218,102 A * 11/1965 Specketer ..... 297/330
3,250,569 A * 5/1966 Gaffney ..... 297/330
3,479,086 A * 11/1969 Sheridan ..... 297/330
3,848,845 A * 11/1974 Bogart ..... 248/393
4,993,777 A * 2/1991 LaPointe ..... 297/325
5,169,112 A * 12/1992 Boyles et al. ..... 248/550
5,316,370 A * 5/1994 Newman ..... 297/313
5,333,931 A * 8/1994 Weddendorf ..... 297/334
5,556,163 A * 9/1996 Rogers et al. ..... 297/330
5,651,580 A * 7/1997 LaPointe et al. ..... 297/85
5,918,936 A * 7/1999 Murphy ..... 297/313
6,309,020 B1 * 10/2001 Niikura et al. ..... 297/344.1

* cited by examiner

*Primary Examiner*—Peter M. Cuomo
*Assistant Examiner*—Sarah C. Burnham

(57) ABSTRACT

A lift seat specifically suited for assisting an individual from a seated to a standing position or from a standing to a seated position. The lift seat has a hinged seat platform that is pivotally coupled with a base platform and a lift link assembly coupled to a wheeled carriage. The wheeled carriage is driven linearly by a motor powered lead screw that operates in either direction of rotation to advance the position of the carriage. The movement of the carriage in one direction causes the lift link assembly to raise the seat platform while the movement in the opposite direction causes the platform to lower.

2 Claims, 5 Drawing Sheets

FIG. 4
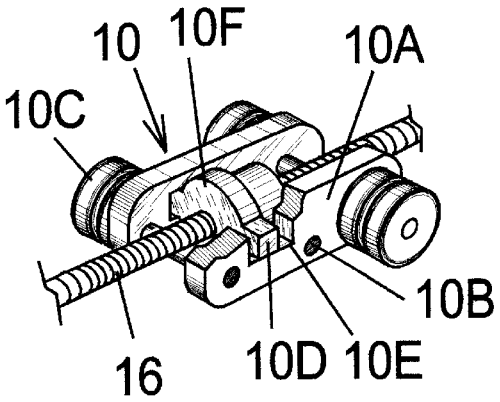
FIG. 3
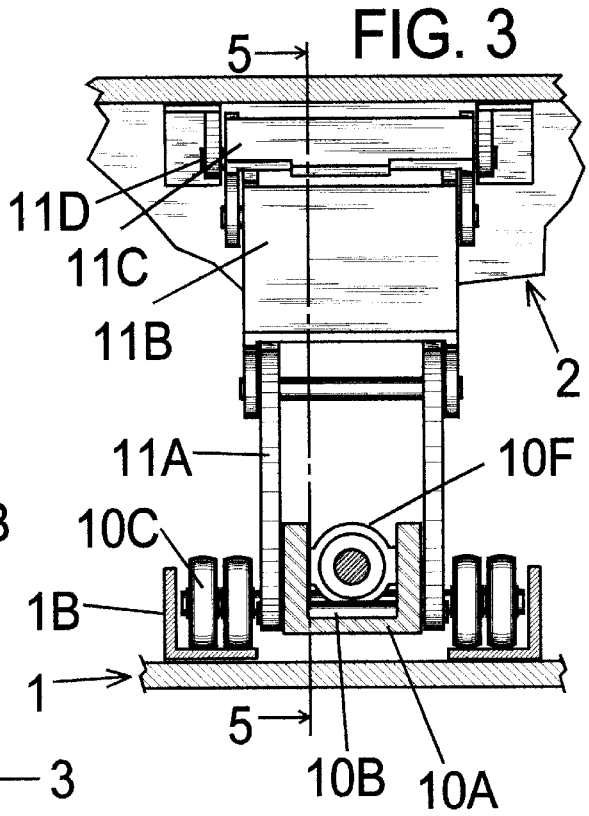
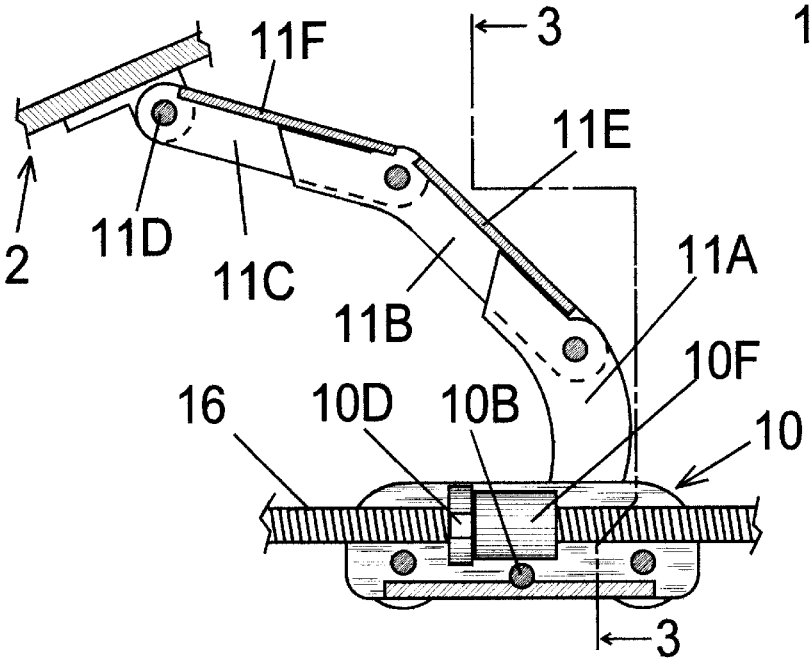
FIG. 5

PORTABLE LIFT SEAT APPARATUS

CROSS-REFERENCE TO RELATED APPLICATIONS

Provisional Patent Application, Serial No. 60/314,955 filed Aug. 24, 2001, PORTABLE LIFT SEAT.

STATEMENT REGARDING FEDERALLY SPONSORED RESEARCH OR DEVELOPMENT

Not Applicable

REFERENCE TO A COMPUTER PROGRAM APPENDIX

Not Applicable

BACKGROUND OF THE INVENTION

The present invention pertains generally to devices used to aid persons who have difficulty lowering into, or rising from, a seated position and more particularly to a powered lift seat that is easily transportable from place to place.

Persons with muscle weakness often require assistance to raise themselves from a seated position, or to lower themselves into a seated position in a controlled manner in order to avoid injury.

Lift chairs which provide this function have been available to the public for some time, such as is described in U.S. Pat. No. 4,083,599 (Gaffney, Apr. 11, 1978). However, the lift chairs known in the art are heavy and have the disadvantage of not being portable, which restricts the person's movements outside the care facility or private home.

Portable lift devices are available that typically utilize springs to assist the person in rising or seating such as described in U.S. Pat. No. 5,082,327 (Crisp, Jan. 21, 1992). However, these devices have the limitation of requiring some muscular effort by the user, since the springs can provide only approximately 80% of the required force to support the person.

Similarly, U.S. Pat. No. 5,333,931 (Weddendorf, Aug. 2, 1994) is portable but the seating surface, in the raised position, tilts the user forward into an awkward position which persons with limited leg strength cannot use. The forward tilt also forces the seat backward unless restrained. Additionally, U.S. Pat. No. 6,113,188 (Stewart, Sep. 5, 2000) describes a device which presents a more comfortable seating configuration when raised. However, it incorporates an air filled bellows which will depress some amount, depending on the user's weight, resulting in vertical instability. Also, the lifting mechanism requires a motor driven air compressor, the combination of which is typically of low efficiency, such that battery life is limited and may be heavy to lift and carry.

Of particular concern to users with limited muscle strength is the process of transitioning from a standing position to sitting on the raised platform; and, conversely, achieving a standing position from being seated on the raised platform of the apparatus. Neither the lift chairs nor the lift seats known in the art present a configuration which is totally suitable for this purpose.

Accordingly, there exists a need for a lift seat that is lightweight, compact and portable which can support the entire weight of a typical user, and which is both convenient and comfortable for the user. The current invention fulfills that need as well as others and generally overcomes the deficiencies of lift seats and chairs know in the art.

BRIEF SUMMARY OF THE INVENTION

The present invention is an apparatus that is a portable lift seat for use by persons who need assistance in rising from a seated position or lowering into a seated position. By way of example and not of limitation, the apparatus of the present invention comprises a seat base and a two-piece seat platform which are interconnected and stabilized by positioning levers; and a motorized lift mechanism which is powered by removable and rechargeable batteries, and which may be augmented by tension springs. The motorized lift mechanism is comprised of multiple lift links which stage the lifting effort.

Several advantages of this invention, as compared to the prior art, are:

(a) The seat platform is formed of two pieces, hinged together, such that the rear portion remains horizontal while the front portion tilts forward during the lift process. Thus the point of contact between the user and the seat, when the user engages the seat, is approximately in the center of the seat platform, and the user need not reposition himself/herself following the seating process, or in preparation for disengaging from the seat. This configuration also minimize the tendency of the seat to move backward during engagement or disengagement by the user.

(b) The multi-staged lifting mechanism reduces required motor torque, thereby reducing motor size and resulting in increased battery life and a reduction in overall seat size and weight.

(c) Lightweight non-metalic springs may be used to augment the lifting force, thereby further increasing battery life while retaining reduced seat weight and size.

The apparatus of the present invention is lightweight, compact and self-contained. The apparatus utilizes rechargeable batteries for the power source, so that it is extremely portable. It incorporates a unique lift mechanism that is very efficient, thereby achieving long battery life; and also a unique seat configuration that provides and effective lifting platform for persons with reduced muscle strength.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings that are for illustrative purposes only:

FIG. 3 is a back view in partial cutaway of the carriage and lift link members shown in FIG. 2.

FIG. 4 is an isometric view of the carriage in partial cutaway with some of the components removed for clarity.

FIG. 5 is a side view in partial cutaway of the carriage and lift link members shown in FIG. 3.

DETAILED DESCRIPTION OF THE INVENTION

Referring more specifically to the drawings, for illustrative purposes the present invention is embodied in the apparatus generally shown in FIG. 1 through FIG. 9. It will be appreciated that the apparatus may vary as to configuration and as to details of the parts, and that the method may vary as to the specific steps and sequence, without departing from the basic concepts as disclosed herein.

Figure 1:
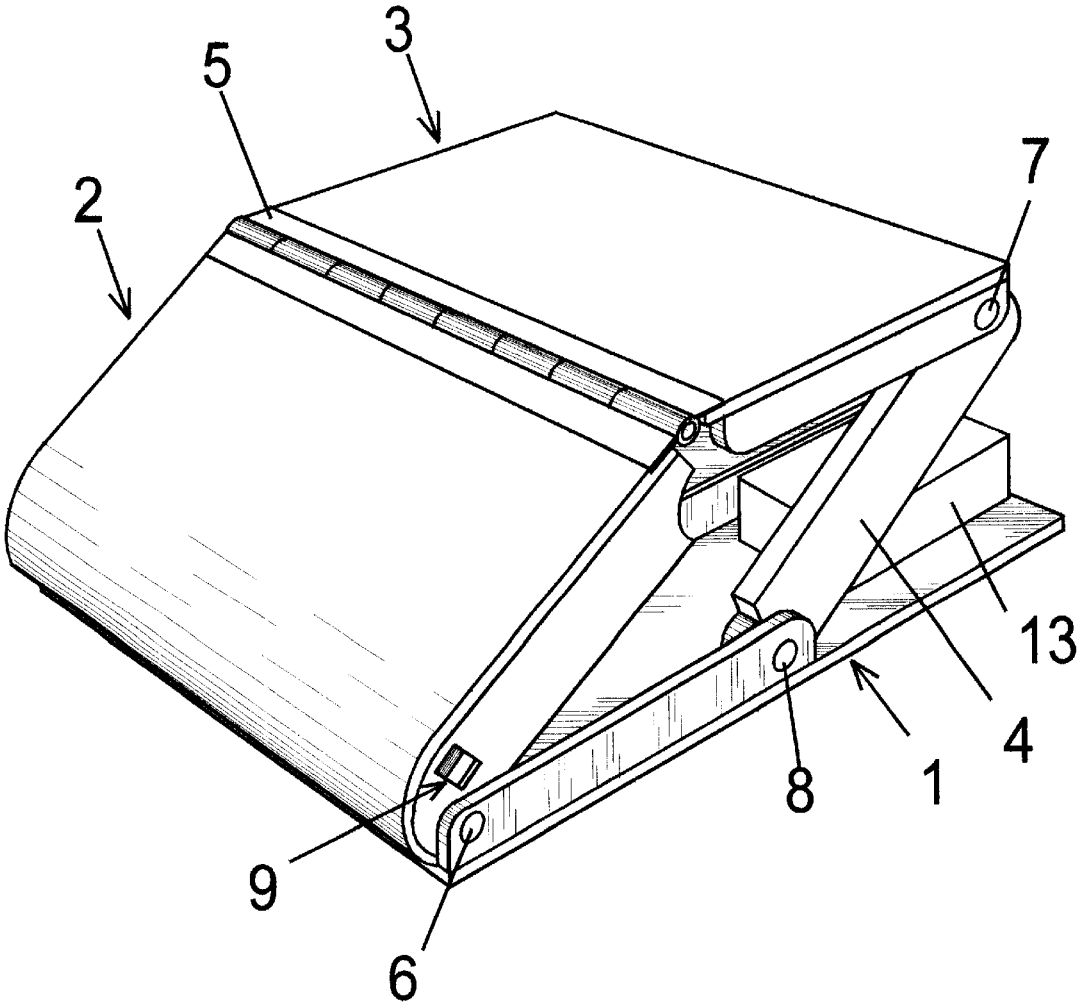
FIG. 1 is a perspective view of the apparatus according to the present invention.

Referring first to FIG. 1, a lift seat apparatus of the present invention is generally shown. The lift seat comprises a base platform (1), a front seat platform (2), a rear seat platform (3) and seat lever (4). The front seat platform (2) and rear seat platform (3) are rotationally connected by a hinge (5), and the front seat platform (2) is rotationally connected to the base platform (1) at the front of the seat by the front seat pins (6). The seat lever (4) is rotationally connected to the rear seat platform (3) at its upper end by rear seat pins (7), and to the base platform at its bottom end by the base pins (8). In operation, a lift mechanism (not visible in this view) produces a vertical lift force on the underside of both the front and rear seat platforms (2,3). During the lifting process, the front seat platform (2) rotates about the front seat pins (6) to tilt forward, while the rear platform (3) rotates about the hinge (5) and the rear seat pin (7) and follows an arc determined by the rotation of seat lever (4) about base pin (8), and thus is raised in approximately a horizontal plane. The resulting seat configuration provides a natural, supportive seating surface for the user during the raising/lowering processes. A control switch (9) allows the user to raise or lower the seat, or to stop it at an intermediate position.

Figure 2:
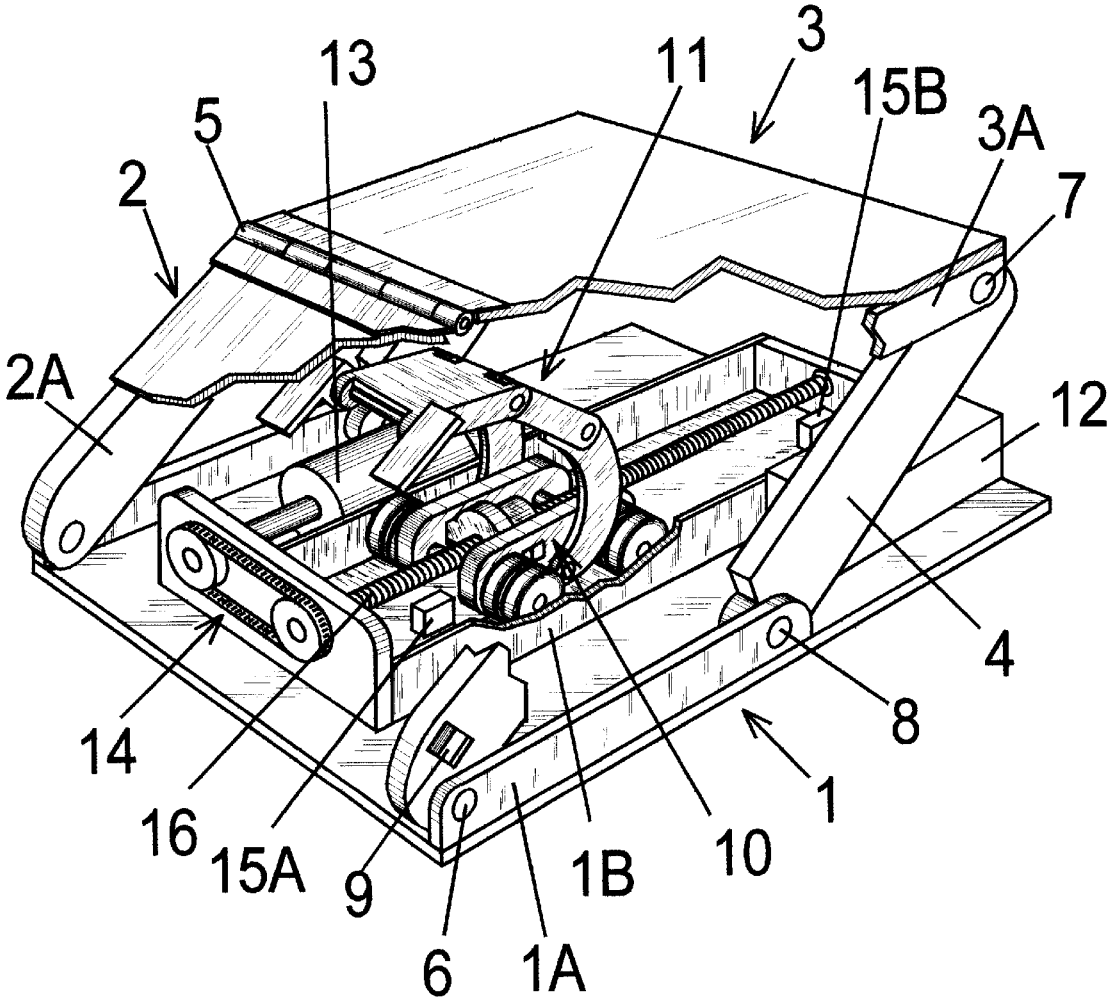
FIG. 2 is a perspective view in partial cutaway of the apparatus shown in FIG. 1.

The cutaway view of FIG. 2 shows the lift components, which comprise a battery operated motor (13), a belt driven lead screw (16), a wheeled carriage assembly (10), a lift assembly (11), a battery pack (12), a user control switch (9), and limit switches (15A, 15B).

It is preferred that a commercially available battery powered reversible motor (13), which incorporates high torque speed-reduction gearing, be used to rotate a lead screw (16) through a drive belt system (14). Rotation of the lead screw (16) causes the carriage assembly (10) to be moved laterally along the axis of the lead screw (16). Horizontal movement of the carriage assembly (10) is translated to a vertical lift force as explained below (see FIG. 6). This configuration provides a great amount of overall mechanical advantage, permitting the use of a small, lightweight motor/battery system. Limit switches (15A, 15B) de-energize the motor (13) at both ends of carriage travel to automatically terminate raise/lower functions.

FIGS. 3, 4 and 5 provide details of the carriage assembly (10) and lift assembly (11). The carriage comprises a lead screw nut (10F) and a carriage frame (10A) which supports the carriage wheels (10C) and the carriage lift pin (10B). The carriage assembly rolls on carriage rails (1B) during the lift operation. A sliding connection is provided between the lead screw nut (10F) and the carriage frame (10A), by a drive slot (10E) in the carriage frame as shown in FIG. 4.

The drive slot (10E) is necessary to provide travel margin due to rotational inertia of the drive mechanism. As the lead screw nut (10F) is driven forward by rotation of the lead screw, to lift the seat, a trunion pin (10D), which is part of the commercial lead screw/drive nut assembly, engages the front end of the drive slot (10E), and then begins to transmit forward movement to the carriage frame(10A). When the seat is being lowered and approaches the collapsed position, the rear limit switch interrupts power to the motor (13); however, inertia of the rotating components cause the lead screw (16) to continue to turn for an additional period of time causing the lead screw nut (10F) to continue to travel an additional amount. The drive slot (10E) prevents this additional travel from being transferred to the carriage (10), thereby preventing overtravel and possible damage to the lift components.

FIG. 5 shows that the three lift links (11A,B,C), used in this embodiment, are rotationally connected, in sequence, but that the upper webbing (11E) of link 11B limits the rotation of link 11A in a clockwise direction. Similarly, the upper webbing (11F) of link 11C limits the rotation of link 11B in a clockwise direction. Moreover, the spacing between webbing 11E and 11F is such that the counterclockwise rotation of link 11B is limited (see FIG. 6).

Figure 6:
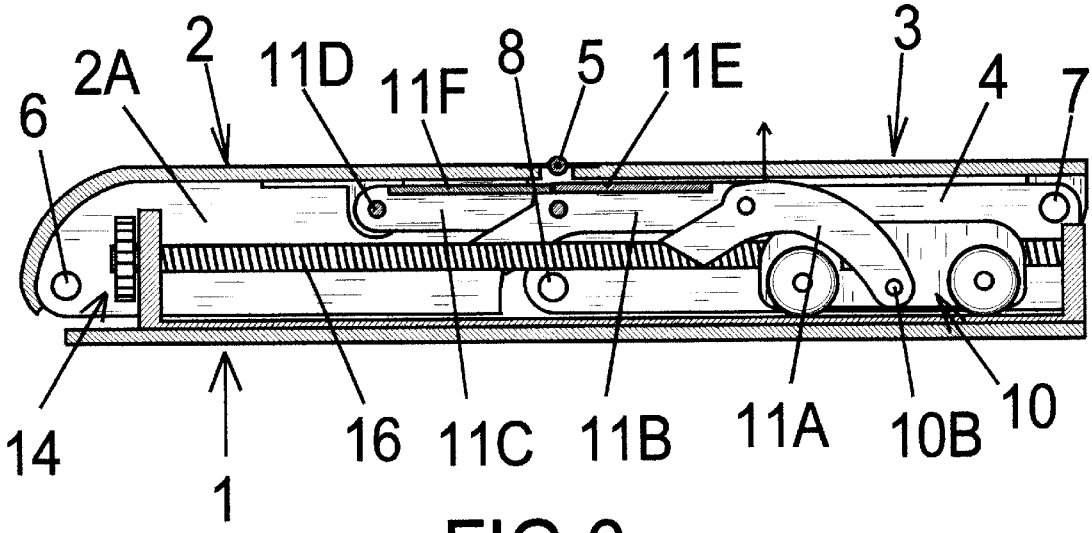
FIG. 6 is a side view of the lift apparatus shown in FIG. 2 with the seat platforms in the collapsed position.

FIG. 6 is a side view of the lift apparatus with the seat in the fully seated position. In this position, links 11B and 11C are maintained in a horizontal configuration by the contact of their respective link webs (11E,F) and therefore act together as a single unit during the subsequent lift action. As the carriage assembly (10) is driven forward (towards the front of the seat) by the lead screw (16), the lift link assembly (11), comprising lift links 11A, 11B, and 11C, is constrained from moving forward by link pin 11D. Therefore, lift link 11A rotates clockwise about the carriage pin (10B) to provide a vertical force on the back seat platform (3) as shown. The configuration of this embodiment is designed such that the initial lift angle is adequately large to enable the lifting mechanism to function with minimum required motor torque. A value of approximately thirty to forty five degrees is used for this embodiment, but may be increased or decreased depending on commercial components used in the embodiment.

Figure 7:
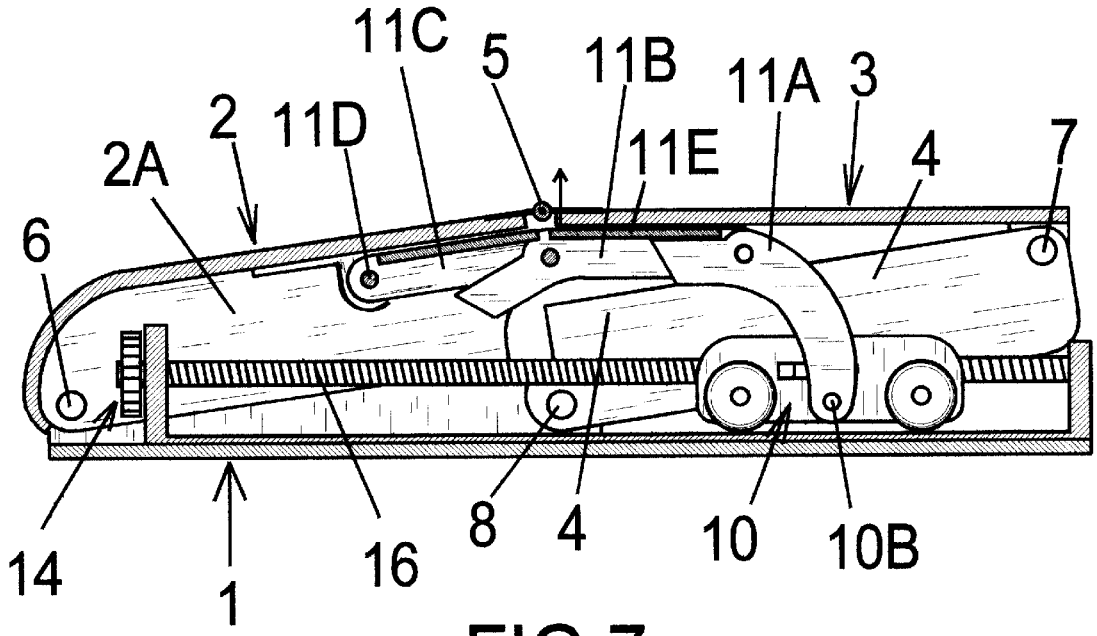
FIG. 7 is a side view of the lift apparatus shown in FIG. 2 with the seat platforms partially raised.

Referring now to FIG. 7, which is the same view as in FIG. 6, at the point in the lift sequence when lift link 11A has rotated sufficiently such that the upper webbing (11E) of link 11B is engaged. At this point, lift links 11A and 11B act as a unit, and both are rotated clockwise about the carriage pin (10B) as the carriage assembly (11) moves forward. Lifting is then transferred forward on the rear seat platform (3), as shown; the position of which is chosen to meet the minimum lift angle requirement noted above.

Figure 8:
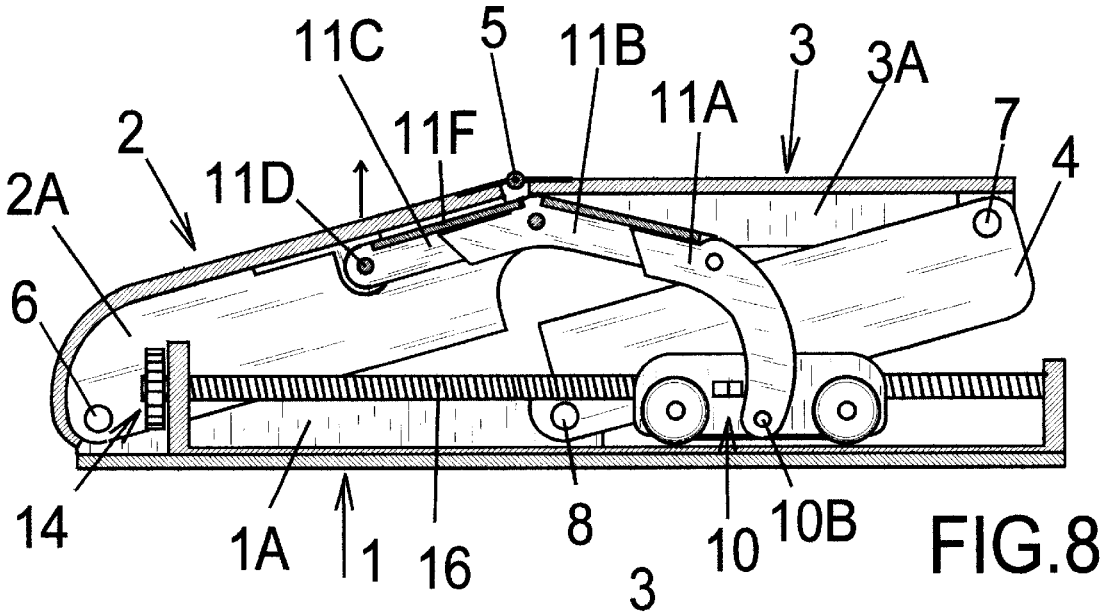
FIG. 8 is a side view of the lift apparatus shown in FIG. 2 with the seat platforms partially raised to an intermediate position.

FIG. 8 illustrates the next stage in the lift sequence, in which lift link 11B engages the upper web (11F) of lift link 11C, transferring the lift force to the front platform (2), again at the desired minimum lift angle.

Figure 9:
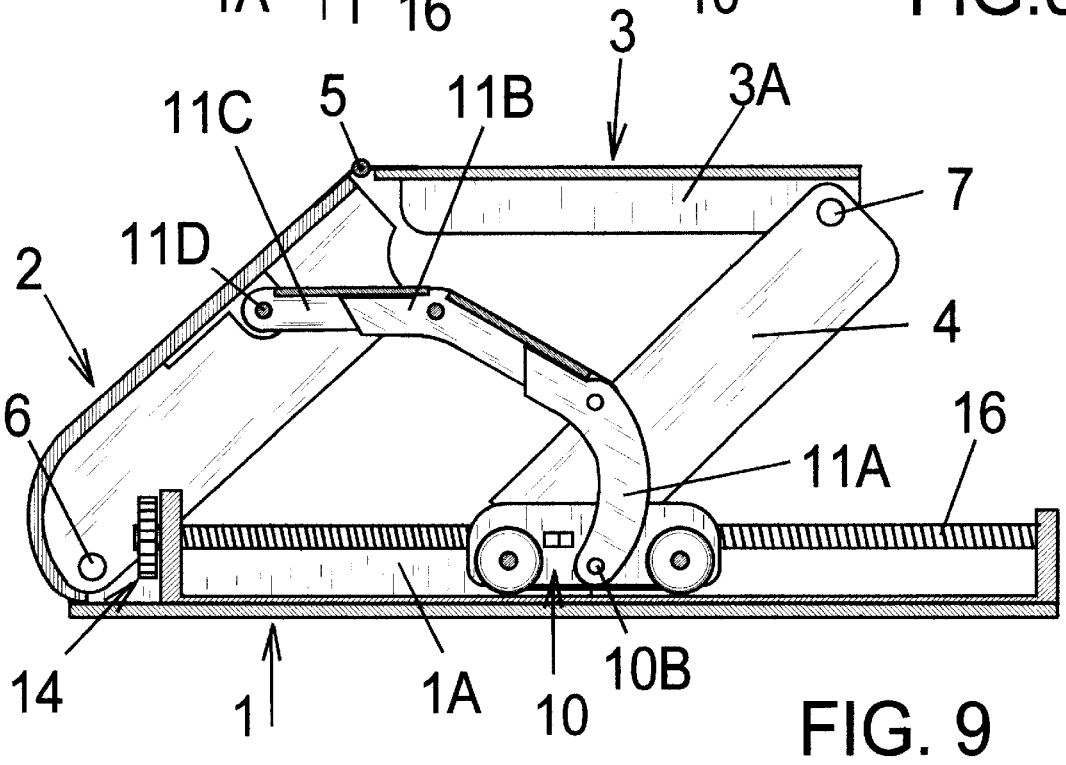
FIG. 9 is a side view of the lift apparatus shown in FIG. 2 with the seat platforms in the fully raised position.

Finally, as the carriage assembly approaches its maximum forward travel, as determined by the front limit switch (15A), the seat is in its fully raised position as shown in FIG. 9. Since the front and rear seat platforms (2,3) are rotationally connected by the seat platform hinge (5), the seating surface is bent as shown to form a configuration which is convenient for the user to engage, or to disengage.

Additional embodiments to the invention might include increasing the number of lift links to increase the minimum lift angle, thereby further reduce motor torque requirements. The disadvantage of this variation would be added cost, complexity, and possibly weight. Conversely, the number of links could be reduced to reduce cost, complexity and weight, if available motor torque is not an issue.

The lifting force of the motor may be supplemented by tension springs attached between the front frame member and the carriage assembly. Non-metallic latex tubing is preferred in this embodiment for weight considerations although other materials would be suitable.

An alternative embodiment consists of a dual-drive system, utilizing two lead screws to drive two carriage assemblies, one on each side of the seat frame, as opposed to the present embodiment with one lead screw and carriage in the center of the seat frame. The advantage of this approach is that the forces imposed on each lifting system is halved, which may simplify design and manufacturing. A disadvantage is that weight and cost are increased. Also, it is necessary to synchronize rotation of the two lead screws so that carriage positions are equivalent on both sides, otherwise tilting of the seat platform(s), and/or component damage could occur.

In use, the lift seat of the present invention is positioned on top of a stable horizontal platform, which is preferably at a height convenient for the user. Such stable platforms include a conventional chair or wheelchair, or an airplane seat, for example. The lift seat must initially be in a raised position. The user stands immediately in front of, and adjacent to, the lift seat, and simply allows his/her body to lean back onto the seat. The user then toggles the control switch to the down position. The seat will stop automatically when the fully seated position is reached. In order to raise himself/herself, the user toggles the control switch to the up position. The seat will stop automatically when the fully raised position is reached.

With use of the apparatus, the user can readily enter or exit from a chair. The apparatus may be easily used at home, in public, in a vehicle or with outside activities.

Although the description above contains many specificities, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one of more." All structural, chemical and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A lift seat apparatus, comprising:

a base platform;

a seat platform having a front section and a back section, (the two sections) the front section and the back section being rotationally connected to each other and to the base platform;

a lift mechanism positioned between the base platform and the seat platform;

said lift mechanism comprising a linear drive unit and multi-stage lift link assembly for translating a horizontal force provided by the linear drive unit to a vertical force necessary to lift the seat platform;

wherein said multi-stage lift link assembly comprises a plurality of links which are rotationally connected to each other and sequentially engage a bottom surface of said seat platform, thereby transferring said vertical force from one link to the next during a lifting process.

2. An apparatus as recited in claim 1, wherein said linear drive unit comprises:

a battery driven, reversible, geared motor;

a lead screw, rotationally driven by the geared motor;

a wheeled carriage linearly driven by the lead screw thus providing a horizontal force;

a means for limiting travel of the wheeled carriage; and a means for user-controlled operation of the motor.

* * * * *